US006272295B1

(12) United States Patent
Lindblad et al.

(10) Patent No.: US 6,272,295 B1
(45) **Date of Patent: *Aug. 7, 2001**

(54) APPARATUS INCLUDING AND USE OF AN ENHANCED TONER AREA COVERAGE SENSOR TO MONITOR FILMING LEVELS ON A PHOTORECEPTOR SURFACE

(75) Inventors: Nero R. Lindblad, Ontario; Michael C. Mongeon, Walworth; Raymond D. Wilcox, Fairport, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,700

(22) Filed: Nov. 24, 1999

(51) Int. Cl.[7] ..... G03G 15/00; G03G 21/00
(52) U.S. Cl. ..... 399/26; 399/71
(58) Field of Search ..... 399/26, 43, 71, 399/72, 48, 343, 347, 74

(56) References Cited

U.S. PATENT DOCUMENTS 5,162,874 * 11/1992 Butler ..... 399/74 X
5,519,497 5/1996 Hubble, III et al. .
5,574,527 11/1996 Folkins .
5,606,721 * 2/1997 Thayer et al. ..... 399/34
5,887,221 3/1999 Grace .
5,903,797 5/1999 Daniels et al. .
5,950,040 9/1999 Mestha et al. .

FOREIGN PATENT DOCUMENTS 60-8882 * 1/1985 (JP) .
2-275477 * 11/1990 (JP) .
6-95555 * 4/1994 (JP) .
10-63148 * 3/1998 (JP) .
10-91003 * 4/1998 (JP) .

* cited by examiner

*Primary Examiner*—Quana M. Grainger
(74) *Attorney, Agent, or Firm*—Oliff & Berridge, PLC

(57) ABSTRACT

A method for monitoring filming levels on a photoreceptor surface of a printing machine includes the use of an enhanced toner area coverage sensor to measure level of filming of substantially the entire photoreceptor surface, the sensor being located at a point downstream from a cleaning station of the printing machine. When the measurement indicates that the filming is unacceptably high on a portion of the photoreceptor surface, corrective action is implemented, for example filming removal. The sensor is preferably mounted in a manner such that it may be moved over substantially the entire surface of the photoreceptor. Also, an electrostatic voltmeter is preferably mounted along with the sensor in order to monitor the charging of the photoreceptor surface.

19 Claims, 4 Drawing Sheets

APPARATUS INCLUDING AND USE OF AN ENHANCED TONER AREA COVERAGE SENSOR TO MONITOR FILMING LEVELS ON A PHOTORECEPTOR SURFACE

BACKGROUND OF THE INVENTION

1. Field of the Invention

This invention relates to an apparatus and method for effectively measuring and monitoring the filming level on a photoreceptor.

2. Description of the Related Art

Sensors have been used for many purposes in electrostatographic printing machines. For example, U.S. Pat. No. 5,574,527 describes a method and apparatus for sensing multiple process parameters with a single sensor in a printing machine. It is described that the sensor can be used to sense the photoreceptor belt seam to insure that the latent image is not formed on the photoreceptor belt seam, to sense the toner density to control the toner dispenser, to sense the photoreceptor charging, developer bias, image exposure and image processing systems, to sense the presence of copy-sheets in a paper transport, and to sense the type of copy-sheet. The sensor is described to be uniquely located in the printing machine in order to function as described. Sensing of photoreceptor filming with the sensor is not described.

Most typically, infrared densitometers such as extended toner area coverage sensors are used in association with developing stations to monitor the toner density on the photoreceptor in order to control the amount of toner dispensed.

U.S. Pat. No. 5,903,797 describes a method and apparatus for monitoring cleaning performance to predict printing machine cleaner life. The method and apparatus employ a sensor and artificial stress conditions to determine the cleaner brush life. In the method, a comparative analysis is done between the data from the monitoring of a normal cleaning residual toner particle mass and the data from the artificial stress conditions cleaning residual toner particle mass to predict brush cleaner life reliably. The monitoring is conducted in a non-printing area of the photoreceptor. It is described that degradation in the ability of the cleaning brush to remove toner particles from the photoreceptor becomes detectable under the artificial stress conditions. Monitoring of filming on the entire photoreceptor surface under normal printing conditions is not described.

SUMMARY OF THE INVENTION

It is an object of the present invention to develop a method for effectively and efficiently monitoring the filming level of substantially the entire surface of the photoreceptor. It is also an object of the present invention to develop a method that can detect unacceptable filming at any portion of the photoreceptor surface early on so that corrective action can be taken prior to failure. It is a still further object of the invention to develop an electrostatographic printing machine containing components that can effectively and efficiently carry out the desired monitoring of filming levels on the photoreceptor surface.

These and other objects are achieved by the present invention. The invention relates to a method for monitoring filming levels on a photoreceptor surface of an electrophotographic/electrostatographic printing machine, comprising scanning an enhanced toner area coverage sensor over the photoreceptor surface at a point downstream from a cleaning station that removes particles from the photoreceptor surface to measure the filming level on the photoreceptor surface, and continuing the scanning with the enhanced toner area coverage sensor to obtain a filming level profile of substantially all of the photoreceptor surface.

The invention also relates to a method for monitoring filming levels on a photoreceptor surface of an electrophotographic/electrostatographic printing machine, comprising beginning with a photoreceptor surface substantially free of any filming, and thereafter repeatedly scanning an enhanced toner area coverage sensor over the photoreceptor surface to measure the filming level on the photoreceptor surface, wherein the enhanced toner area coverage sensor is mounted at a point downstream from a cleaning station that removes particles from the photoreceptor surface.

The invention still further relates to a printing machine comprising a photoreceptor having an image forming surface, a charging station to provide a charge to the image forming surface of the photoreceptor, an exposure station to form a latent image on the charged image forming surface of the photoreceptor, a developing station to provide toner particles and develop the latent image on the image forming surface of the photoreceptor, a transfer station to transfer the developed latent image from the image forming surface of the photoreceptor, a cleaning station to remove residual toner particles remaining on the image forming surface of the photoreceptor following transfer, and at a point downstream from the cleaning station, an enhanced toner area coverage sensor mounted in a manner enabling movement of the sensor over the image forming surface of the photoreceptor.

DETAILED DESCRIPTION OF PREFERRED EMBODIMENTS

Figure 1:
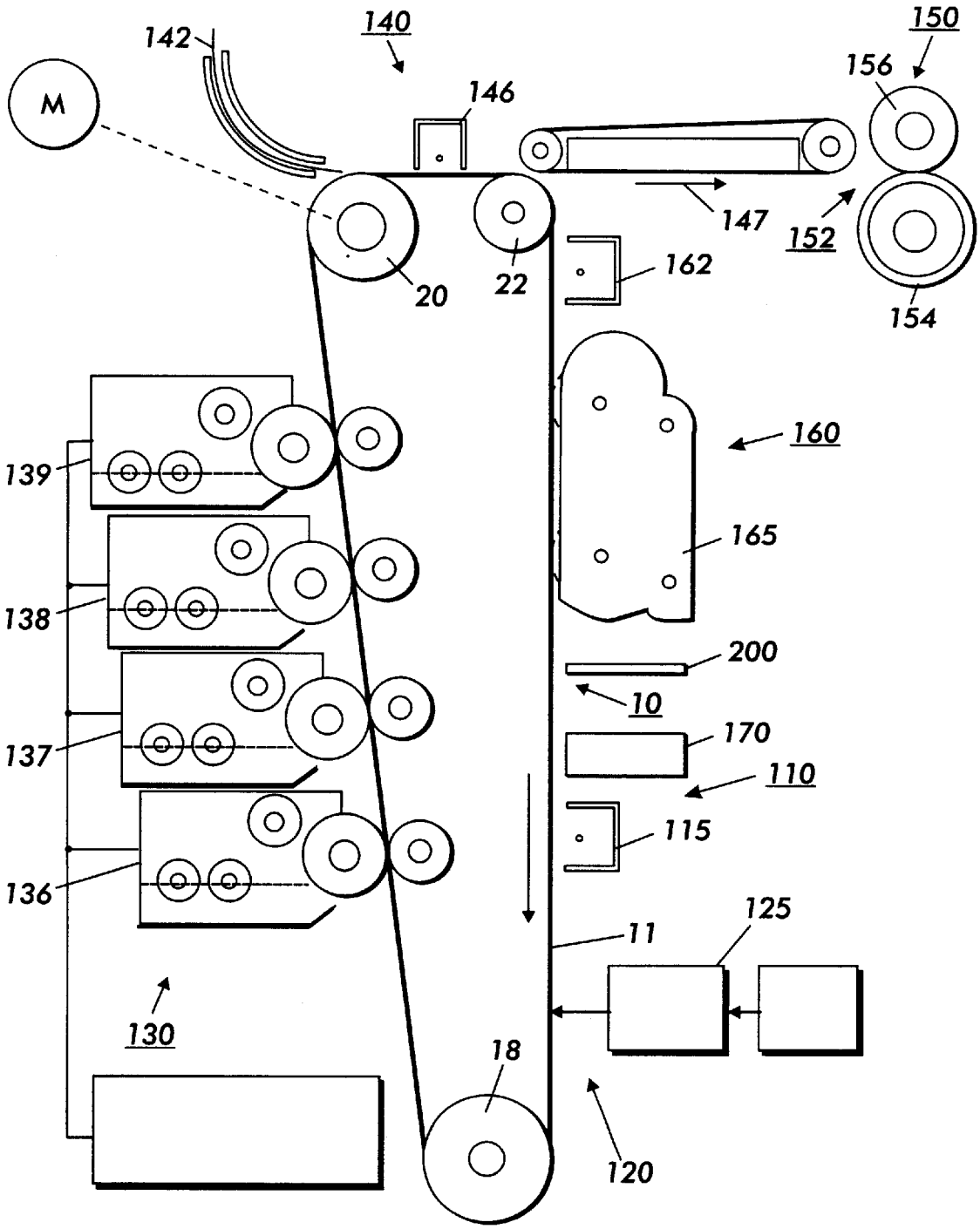
FIG. 1 is a schematic of an electrostatographic printing machine containing an enhanced toner area coverage sensor downstream from a cleaning station in accordance with an aspect of the invention.

The basic xerographic process used in a xerographic imaging device, i.e., an electrostatographic or electrophotographic printing machine, generally involves an initial step of charging a photoreceptor (photoconductive member) surface to a substantially uniform potential at a charging station. The charged surface of the photoconductive member is thereafter exposed to a light image of an original document to selectively dissipate the charge thereon in selected areas irradiated by the light image. This procedure records an electrostatic latent image on the surface of the photoconductive member corresponding to the informational areas contained within the original document being reproduced. The latent image is then developed by bringing a developer material including toner particles into contact with the latent image. The toner particles are attracted to the latent image, forming a toner image on the photoconductive member which is subsequently transferred to a copy sheet (paper, transparency, etc.). The transfer to the copy sheet may either be direct or indirect through an intermediate step of first transferring the developed image to a transfer member. The copy sheet having the toner image thereon is then advanced to a fusing station for permanently affixing the toner image to the copy sheet in image configuration.

In xerographic imaging devices using a drum-type or an endless belt-type photoreceptor member, the photosensitive surface thereof can contain more than one image at one time as it moves through various processing stations. The portions of the photosensitive surface containing the projected images, so-called "image areas", are usually separated by a segment of the photosensitive surface called the "inter-document space." After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface and a fully discharged portion of the photosensitive surface between the image areas.

The approach utilized for multicolor xerographic printing is substantially identical to the process described above. However, rather than forming a single latent image on the photosensitive surface in order to reproduce an original document, as in the case of black and white printing, multiple latent images corresponding to color separations are sequentially recorded on the photosensitive surface. Each single color electrostatic latent image is developed with toner of a color complementary thereto and the process is repeated for differently colored images with respective toner of complementary color. Thereafter, each single color toner image can be transferred to the copy sheet, optionally through a transfer member, in superimposed registration with the prior toner image, creating a multi-layered toner image on the copy sheet. Finally, this multi-layered toner image is permanently affixed to the copy sheet in a conventional manner to form a finished color copy.

Referring now to the drawings, which are for the purpose of describing a preferred embodiment of the invention and not for restricting same, the various processing stations employed in the reproduction machine illustrated in FIG. 1 will be briefly described.

A reproduction machine, from which the present invention finds advantageous use, utilizes a charge retentive member in the form of the photoreceptor belt 10 consisting of a photoconductive surface and an electrically conductive, light transmissive substrate mounted for movement past charging station 110, exposure station 120, developer stations 130, transfer station 140, fusing station 150 and cleaning station 160. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

Although a photoreceptor belt is illustrated in FIG. 1, it is to be understood that the photoreceptor can take any suitable form known in the art, including a drum, etc.

At charging station 110, a corona device such as a scorotron, corotron, dicorotron or the like indicated generally by the reference numeral 115, charges the belt 10 to a selectively high uniform positive or negative potential. Any suitable control, well known in the art, may be employed for controlling the corona device 115.

Next, the charged portions of the photoreceptor surface are advanced through exposure station 120. At exposure station 120, the uniformly charged photoreceptor or charge retentive surface 10 is exposed to a laser based input and/or output scanning device 125 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station 120, it is discharged to near zero or ground potential for the image area in all colors.

At development station 130, a development system advances development materials into contact with the electrostatic latent images. The development system 135 may include first 136, second 137, third 138 and fourth 139 developer apparatuses. However, this number may increase or decrease depending upon the number of colors, i.e., here four colors are referred to, thus, there are four developer housings. Any suitable form of development known in the art may be used, including, for example, either liquid development or powder toner development, and may be hybrid scavengeless development (HSD), toner cloud development, magnetic brush development, etc.

Sheets of substrate or support material 142, for example paper, transparency, etc., are advanced to transfer station 140 from a supply tray, not shown. Sheets are fed from the tray by a sheet feeder, also not shown, and advanced to transfer station 140 through a corona charging device 146. After transfer, the sheet continues to move in the direction of arrow 147, to fusing station 150.

Fusing station 150 includes a fuser assembly, indicated generally by the reference numeral 152, which permanently affixes the transferred toner powder images to the sheets. Preferably, fuser assembly 152 includes a heated fuser roller 154 adapted to be pressure engaged with a back-up roller 156 with the toner powder images contacting fuser roller 154. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station 160 with a brush, blade or other type of cleaning system 165. A preclean corotron 162 may be located upstream from the cleaning system 165.

Electrostatographic printers and copiers can create often difficult cleaning problems on the photoreceptor imaging surface and, when toners of more then one polarity are involved, these difficult cleaning problems are compounded making it difficult for conventional cleaners to handle.

In a colored image forming apparatus, an electrostatic latent image which is to be developed by a predetermined color is formed on a photoconductor by an optical system as discussed above, the electrostatic latent image is developed by a developing unit and subsequently transferred to a support surface such as copy paper to which it may be permanently affixed by heating or by the application of pressure. After each transfer process, the toner remaining on the photoconductor is cleaned by a cleaning device.

However, when toners, particularly color toners, are cleaned from the photoreceptor surface, there is a tendency for additives in the toner to remain on the photoconductor. Thus, the photoreceptor is not able to be efficiently cleaned. Possible reasons for the additive filming on the photoconductor relate to the size of the additive, the additive filming properties, and the additive concentration in the toner (i.e., the more additive present, the greater the filming on the photoconductor). For example, filming type additives such as zinc stearate (ZnSt) and particle type additives such as Aerosil (silica or silicon dioxide) are essential additives to the color toners to enhance toner flow and stabilize developer conductivity. Particulate titanium dioxide may also be present in toner compositions as additives, and cause filming problems. During the printing process, such additives, particularly ZnSt, are preferentially developed in the background regions of the photoreceptor, not transferred to the print paper, and subsequently smeared on the photoreceptor by the cleaner brushes. As the filming type additive film thickens with time, particles, particularly those of the particle type additives, become embedded in the film, causing a secondary print quality defect referred to as deletions, Charge Area Development (CAD) loss, or lateral charge conductivity. The particles of particle type additive typically have a small size on the order of 40 to 400 nm, and thus cannot be effectively cleaned by insulator brush, electrostatic brush or even blade cleaning devices.

Of course, toner additive filming on a photoreceptor substrate does not necessarily occur uniformly across the entire surface of the photoreceptor. Excessive filming may occur in only one portion, or in different portions, of the photoreceptor surface. Monitoring and locating the filming on the photoreceptor surface is extremely important in maintaining copy quality of the printing machine and in preventing complete failure of the photoreceptor due to excessive filming.

It has been found by the present inventors that an infrared densitometer (IRD) in the form of an enhanced toner area coverage (ETAC) sensor can be used to effectively detect the level of filming, in particular additive filming, on the photoreceptor, and measure the amount of toner passing by the cleaning system, because of the very sensitive specular channel of the ETAC sensor.

ETAC sensors are well known in the art, and thus the function of an ETAC sensor is not extensively discussed here. For example, U.S. Pat. No. 5,519,497, incorporated herein by reference in its entirety, discloses an enhanced toner area coverage (ETAC) sensor. In the operation of this densitometer, collimated light rays are projected onto a photoreceptor. The light rays reflected from the photoreceptor patch are collected and directed onto a photodiode array. The photodiode array generates electrical signals proportional to the total flux and a diffuse component of the total flux of the reflected light rays. The ETAC sensor 200 thus measures the amount of filming on the photoreceptor after the cleaning station using reflected infrared light. The ETAC electrical signal output is in terms of voltage.

The ETAC sensor 200 can detect even very small amounts of filming. This is because the ETAC voltage for a new or clean photoreceptor substantially free of filming is distinctly different from ETAC voltages from photoreceptors having filming. The ETAC sensor starts to detect a film at about the level at which filming becomes larger than a monolayer, which may be at about 50 Angstroms or less. As monolayer coverage, for example with zinc stearate, starts to increase in thickness, the visual appearance of the filming also changes. When the film thickness is about a monolayer, the photoreceptor appears shiny. As the thickness increases, the appearance starts to become dull and milky. The ETAC sensor can detect this initial dullness.

In the present invention, the ETAC is mounted downstream of the photoreceptor cleaning station in order to measure and monitor the filming on the photoreceptor. The ETAC sensor is preferably capable of monitoring substantially all of the surface of the photoreceptor. By substantially all of the surface of the photoreceptor is meant that the sensor is mounted in such a fashion that it can measure and monitor the filming in each of various sectors or panels having a desired size on the photoreceptor surface, and including all areas of the photoreceptor surface such as active image areas, inter-document areas, inboard side and outboard side of the photoreceptor.

Figure 2:
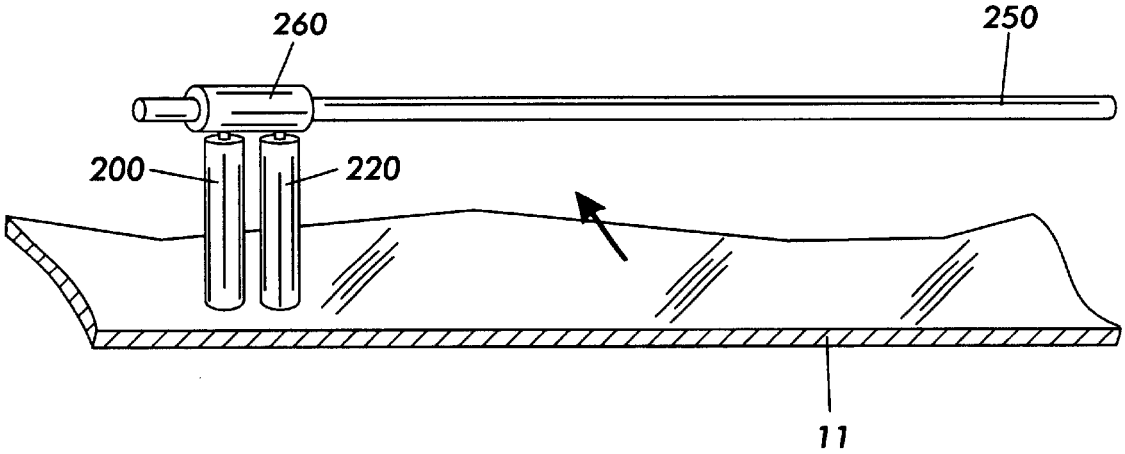
FIG. 2 is an illustration of the sensor mounted with an electrostatic voltmeter in accordance with an aspect of the invention.

To achieve this, the ETAC sensor 200 is preferably mounted via a mount 260 upon a rail 250 as shown in FIG. 2 that enables the ETAC sensor to scan back and forth on the rail over the photoreceptor surface 11. The mount is preferably attached to a motor effecting the scanning of the sensor back and forth over the photoreceptor surface.

Preferably, the scanning is effected while the photoreceptor rotates, for example during printing operations. However, scanning can also be effected during periods of rest. The rate of scanning (i.e., the speed at which the sensor is moved back and forth) can be set as desired in relation to the rotational speed of the photoreceptor so that the sensor effectively monitors substantially the entire surface of the photoreceptor. The ETAC sensor can keep track of the measurements by sector or panel, thus compiling a complete profile or mapping of the photoreceptor surface so that the level of filming anywhere on the photoreceptor surface can be determined. In this way, one can determine the panel or sector that filming is located in, whether the panel or sector runs continuously around the photoreceptor surface in the process direction, and whether it is predominately on the inboard or outboard side of the photoreceptor.

In order to obtain the most useful monitoring, monitoring is most preferably begun when the photoreceptor surface is new, or when it is clean so as to be substantially free of any filming (for example such as achieved following a filming removal operation). In this way, the initial voltage output from the ETAC sensor for the photoreceptor can be obtained and filming beyond a monolayer can then readily be detected in terms of voltage drop as discussed below.

From the monitoring achieved with the ETAC sensor, the information can be used to activate a filming removing device such as known in the art before the filming becomes too thick and impossible to remove and resulting in photoreceptor failure. The filming removing device 170 may be located downstream of the ETAC sensor as shown in FIG. 1. Most preferably, the filming removing device is activated when the ETAC sensor indicates that filming in a panel or sector is becoming unacceptably high. The filming may be removed only in the affected sector, but is more preferably effected to remove filming over the entire surface of the photoreceptor.

What is unacceptably high filming varies for different types of photoreceptors, toner additives and type of cleaning device (brush, blade, etc.) used. Practitioners in the art understand the unacceptable level of filming for a given photoreceptor. The ETAC sensor can readily be set as desired to determine when unacceptable levels of filming for a given photoreceptor are occurring. This is done by setting the voltage level that corresponds to the filming reaching an unacceptable level. Thus, filming is indicated by the ETAC sensor to be unacceptably high when the voltage measurement drops to the set voltage level. In general, by unacceptable level of filming herein is meant a level of filming that either interferes with print quality or that is too high to be removed from the photoreceptor surface.

In a preferred embodiment of the present invention, the ETAC sensor is mounted along with an electrostatic voltmeter (ESV) 220 as shown in FIG. 2. The use of an ESV is well known in the art, for example as described in U.S. Pat. No. 5,950,040, incorporated herein by reference. An ESV measures the voltage level of the photoreceptor surface as it traverses the ESV probe. The surface voltage is a measure of the density of the charge on the photoreceptor, which is related to the quality of the print output. This ensures that the surface potential on the photoreceptor surface is maintained within the required range.

The ETAC sensor thus would monitor filming and toner mass, and can detect cleaner failures as well as monitoring the filming level on the photoreceptor surface. A profile of these parameters can thus be obtained as a function of time as mentioned above. That is, the variations of these parameters from inboard to outboard on a moving photoreceptor can be used to develop a complete informational profile of the photoreceptor surface.

The ESV would measure photoreceptor and toner voltages. This could be used to measure the photoreceptor voltage that would indicate if any adjustments in spacing between the charge corotron and the photoreceptor are needed, i.e., the voltage reading would indicate if the spacing of the charge corotron is out of specification. Exposure uniformity could also be determined, i.e., misalignment or dirtiness of the ROS, for example.

In a still further embodiment of the invention, a cleaning pad can be mounted on the translating device in order to clean the scorotron grid. A single motor could be used to drive the translating device, making it low cost but versatile.

Figure 3:
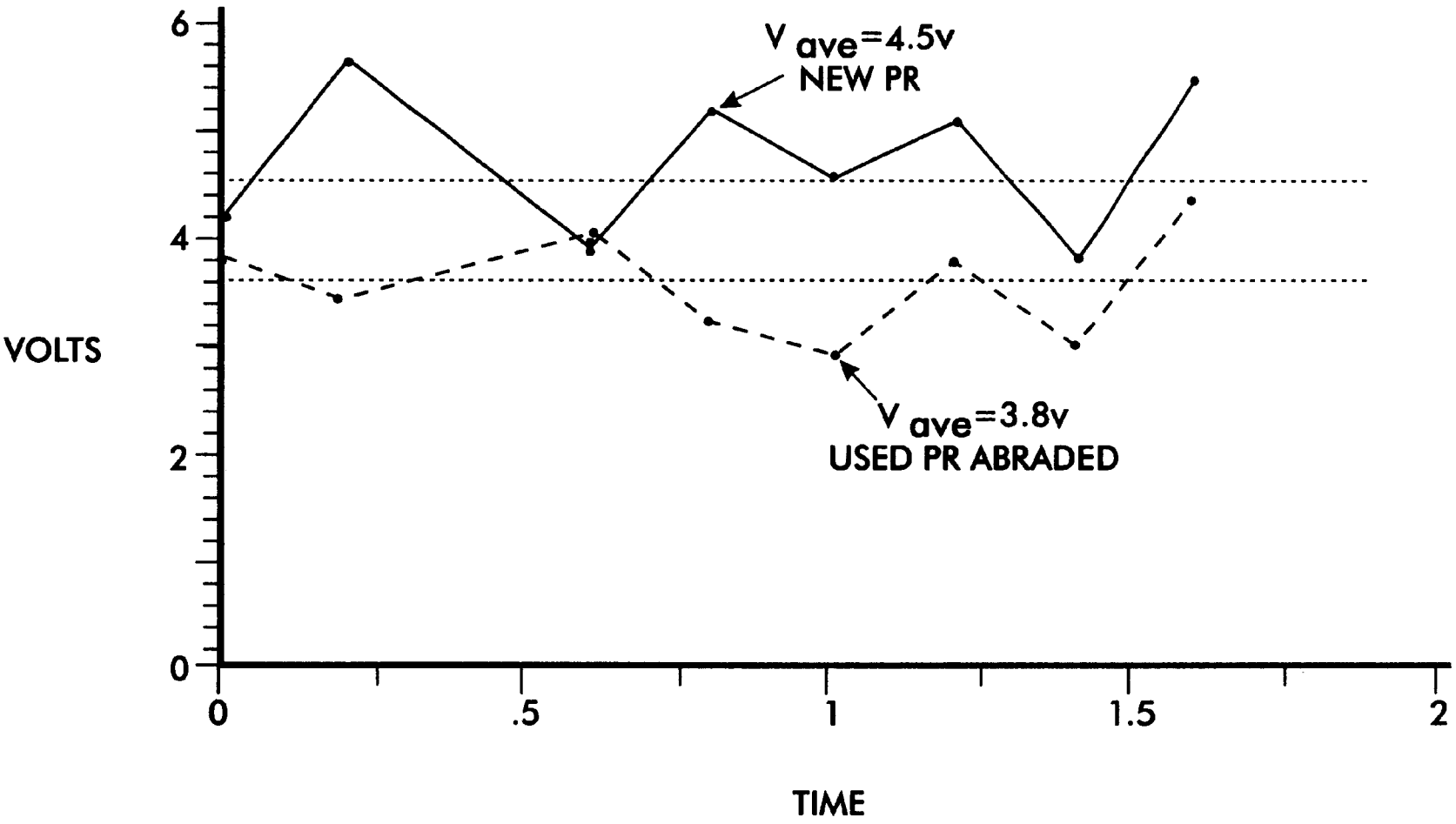
FIGS. 3 and 4 are graphs charting ETAC voltage readings from the photoreceptor.

The invention will now be further explained by way of an example. A segment of the ETAC sensor trace (solid curve) for a new photoreceptor is shown in FIG. 3. As shown, this has a typical value of about 4.5 volts. As printing operations begin, filming of the additives of the toner, in particular with ZnSt, begins on the photoreceptor surface. However, this initial film of ZnSt cannot be detected by the ETAC sensor because the film thickness is around a monolayer. As the print count increases, the surface texture gradually changes and the voltage level drops. This change is caused by the photoreceptor abrasion and is shown as the dashed line in FIG. 3. 3.8 volts as shown is a typical value measured for an abraded photoreceptor. A ZnSt film is likely present on the photoreceptor, but it still cannot be detected by the ETAC sensor. Thus, the 3.8 volts corresponds to a rough photoreceptor surface and not a ZnSt film. This level of roughness occurs around 2 kp.

Figure 4:
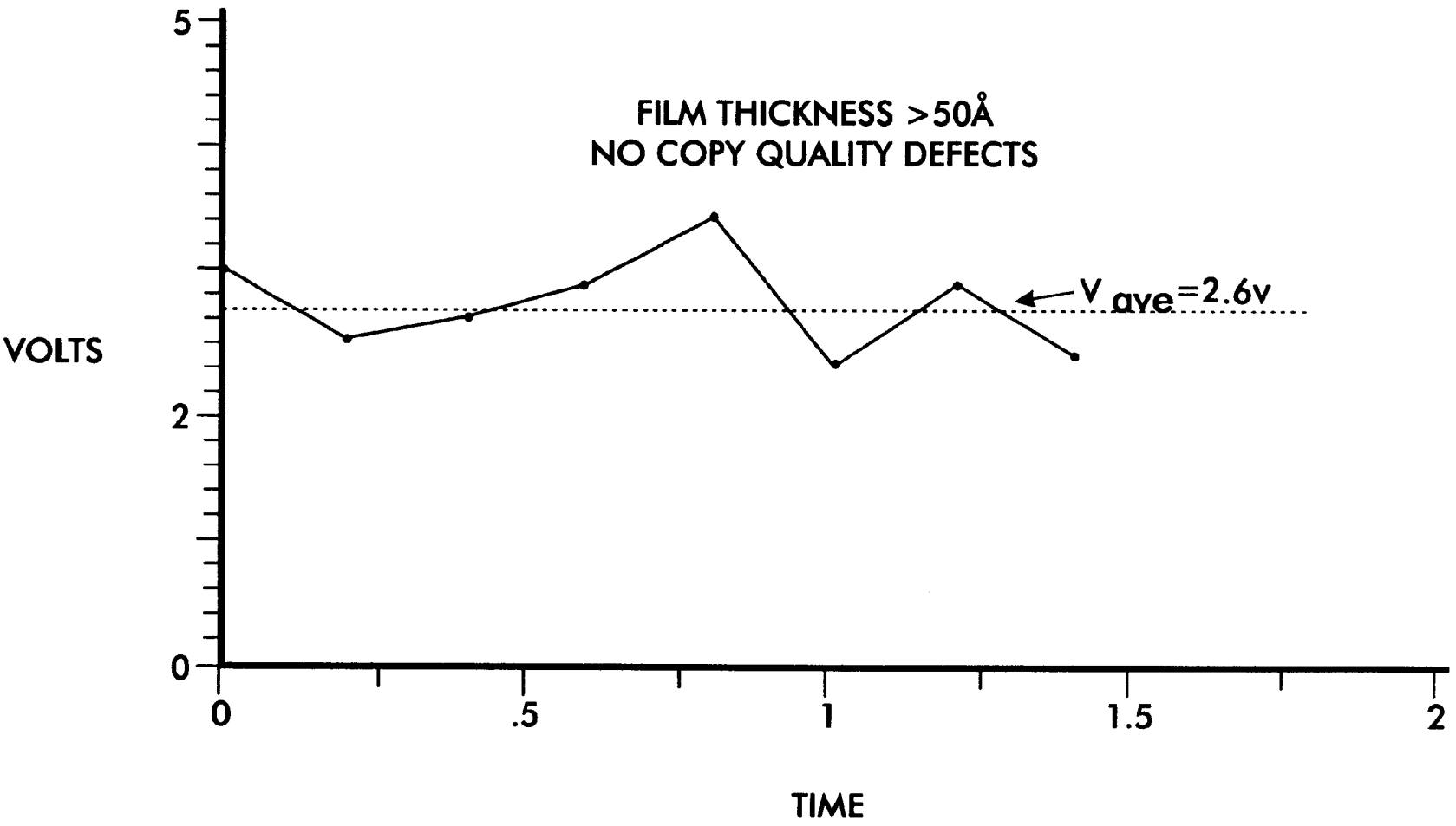

FIG. 4 is an ETAC trace for a ZnSt film. When the film thickness starts to increase, a milky dullness starts to appear on the photoreceptor. This changes the reflectivity on the photoreceptor, and is detected by the ETAC, as shown in FIG. 4. This voltage trace corresponds to a film thickness around 50 Angstroms. Thus, the ETAC starts to detect the film when it is at the thickness where it is visible to the trained eye, probably around 50 Angstroms, or approximately two monolayers.

The foregoing demonstrates that an ETAC sensor can be used to effectively measure and monitor the filming level on a photoreceptor surface, providing information concerning filming so that it can be dealt with well prior to it becoming problematic in the operation of the printing machine.

Through studies, it can be estimated that the upper limit film thickness permissible on selenium is about 300 Angstroms, at which point lateral conduction occurs making the width of the characters smaller. However, it appears that about 300 Angstrom thick films on an Active Matrix (AMAT) photoreceptor using hybrid scavengeless development (HSD) do not cause image defects. Thus, with a development system that does not contact the photoreceptor such as HSD, higher levels of filming can be tolerated before copy quality is adversely affected. Again, as discussed above, the unacceptable level of filming on a given photoreceptor surface can readily be determined by one of ordinary skill in the art, and the corresponding voltage for such filming level set in the ETAC sensor so that it can indicate when the level of filming with such photoreceptor becomes unacceptable.

What is claimed is:

1. A method for monitoring filming levels on a photoreceptor surface, comprising scanning an enhanced toner area coverage sensor over the photoreceptor surface at a point downstream from a cleaning station that removes particles from the photoreceptor surface to measure the filming level on the photoreceptor surface;

continuing the scanning with the enhanced toner area coverage sensor to obtain a filming level profile of substantially all of the photoreceptor surface, and wherein the method further comprises measuring voltage levels of the photoreceptor surface with an electrostatic voltmeter during the scanning of the enhanced toner area coverage sensor.

2. A method according to claim 1, wherein the scanning is conducted by moving the enhanced toner area coverage sensor on a rail back and forth over the photoreceptor surface.

3. A method according to claim 1, wherein the scanning is conducted as the photoreceptor surface rotates.

4. A method according to claim 1, wherein the scanning is conducted when the photoreceptor is at rest.

5. A method according to claim 1, wherein the process further comprises determining when the filming level on the photoreceptor surface is unacceptable by comparing a voltage measurement obtained by the enhanced toner area coverage sensor to a predetermined voltage.

6. A method according to claim 5, wherein if the determining determines that the filming level is unacceptably high, the process further comprises activating a filming removing device.

7. A method for monitoring filming levels on a photoreceptor surface, comprising beginning the method with a photoreceptor surface substantially free of any filming;

and thereafter repeatedly scanning an enhanced toner area coverage sensor over the photoreceptor surface to measure the filming level on the photoreceptor surface, wherein the enhanced toner area coverage sensor is mounted at a point downstream from a cleaning station that removes particles from the photoreceptor surface.

8. A method according to claim 7, wherein the monitoring comprises obtaining voltage measurements from the enhanced toner area coverage sensor for substantially all of the photoreceptor surface and determining when the voltage measurement for any portion of the photoreceptor surface drops to a level indicating an unacceptable filming level at that portion.

9. A method according to claim 8, wherein the method further comprises activating a filming removing device to remove filming from the photoreceptor surface at least at the portion of the photoreceptor surface where the filming level is determined to be unacceptably high.

10. A method according to claim 7, wherein the scanning is conducted as the photoreceptor rotates.

11. A method according to claim 7, wherein the scanning is conducted when the photoreceptor is at rest.

12. A method according to claim 7, wherein the enhanced toner area coverage sensor detects the level of additive filming on the photoreceptor substrate.

13. A method according to claim 12, wherein the additive is one or more of zinc stearate, titanium dioxide or silicon dioxide.

14. A method according to claim 7, wherein the method further comprises measuring voltage levels of the photoreceptor surface with an electrostatic voltmeter during the scanning with the enhanced toner area coverage sensor.

15. A printing machine comprising a photoreceptor having an image forming surface;

a charging station to provide a charge to the image forming surface of the photoreceptor;

an exposure station to form a latent image on the charged image forming surface of the photoreceptor;

a developing station to provide toner particles and develop the latent image on the image forming surface of the photoreceptor;

a transfer station to transfer the developed latent image from the image forming surface of the photoreceptor;

a cleaning station to remove residual toner particles remaining on the image forming surface of the photoreceptor following transfer; and at a point downstream from the cleaning station, an enhanced toner area coverage sensor mounted in a manner enabling movement of the sensor over the image forming surface of the photoreceptor.

16. A printing machine according to claim 15, wherein the printing machine further comprises an electrostatic voltmeter mounted with the enhanced toner area coverage sensor.

17. A printing machine according to claim 16, wherein the enhanced toner area coverage sensor and the electrostatic voltmeter are both mounted on a rail.

18. A printing machine according to claim 15, wherein the printing machine further includes a filming removing device.

19. A printing machine according to claim 15, wherein the enhanced toner area coverage sensor is mounted on a rail.

* * * * *